United States Patent [19]

Lagree et al.

[11] Patent Number: 4,631,450

[45] Date of Patent: Dec. 23, 1986

[54] BALLAST ADAPTOR FOR IMPROVING OPERATION OF FLUORESCENT LAMPS

[75] Inventors: James L. Lagree, Wilkinsburg; Robert T. Elms, Monroeville, both of Pa.

[73] Assignee: North American Philips Lighting Corporation, New York, N.Y.

[21] Appl. No.: 566,240

[22] Filed: Dec. 28, 1983

[51] Int. Cl.[4] ..... H05B 37/00

[52] U.S. Cl. ..... 315/244; 315/232

[58] Field of Search ..... 315/244, 242, 232, 53, 315/188, 59; 361/377

[56] References Cited

U.S. PATENT DOCUMENTS

| | | | |
|---|---|---|---|
| 3,225,255 | 12/1965 | Hume | 315/232 |
| 3,304,464 | 2/1967 | Feinberg | 315/232 X |
| 4,209,730 | 6/1980 | Pasik | 315/244 X |
| 4,238,708 | 12/1980 | Kaneda | 315/244 X |
| 4,399,391 | 8/1983 | Hammer et al. | 315/244 |
| 4,496,880 | 1/1985 | Lück | 315/232 X |

FOREIGN PATENT DOCUMENTS 1011991 12/1965 United Kingdom .

*Primary Examiner*—David K. Moore

*Attorney, Agent, or Firm*—Robert T. Mayer; Bernard Franzblau

[57] ABSTRACT

A ballast adaptor circuit which makes it possible to convert a conventional two lamp rapid start T12 ballast for operation of two T8 fluorescent lamps and by means of a simple modification that does not require cutting wires or extensive rewiring of the T12 ballast device. The adaptor circuit comprises an auxiliary circuit including a tuned series-parallel LC network connected in parallel with either one or both of the lamps. The LC network is tuned to supply an odd harmonic current to the lamps, preferably the seventh harmonic. Improved starting is achieved by adding a series RC circuit and a SIDAC trigger device to the network to produce voltage pulses at the peaks of the AC supply voltage.

20 Claims, 4 Drawing Figures

BALLAST ADAPTOR FOR IMPROVING OPERATION OF FLUORESCENT LAMPS

BACKGROUND OF THE INVENTION

This invention relates to circuits for starting and operating discharge lamps and more particularly to a novel auxiliary network for use in combination with a standard ballast circuit which permits the ballast circuit to reliably start and operate one or more so-called T8 fluorescent lamps.

The two-lamp, series-sequence rapid start ballast is used extensively in commercial and industrial lighting systems in the United States. One type of fluorescent lamp currently used with this ballast is the standard T12 (1.5 in. diameter), 4 ft. long, 40 W lamp (designated, for example, F40CW). Standard 40 W T12 fluorescent lamps contain about 2 Torr Ar plus a small amount of Hg. They operate nominally at 105 V (RMS) and 425 ma (RMS). There is presently available a two-lamp rapid start ballast designed to start two such lamps in series sequence and to operate them in series with a 120 V AC, 60 Hz ballast input. The electron loss rate is higher in T8 lamps than it is in T12 lamps (increased ambipolar diffusion rate). In order to maintain the discharge, the electron production rate must be increased in T8 lamps by increasing the applied electric field. Such a lamp will then operate at increased power loading so that it would not be compatible with the existing T12 ballasts.

It would be desirable to be able to substitute the new 4 ft. long T8 lamp (1.0 in. diameter) as a direct replacement for the T12 lamp since the T8 lamps have several advantages over T12 lamps. For example, the T8 lamps have higher efficacies than standard T12 lamps and they can be manufactured at a significantly lower cost than T12 lamps because they require only two-thirds as much glass and phosphor. Additionally, shipping and warehousing costs are greatly reduced for T8 lamps since many more T8 lamps can be shipped in a given size container.

Although it is easy to remove the T12 lamps from a luminaire and replace them with T8 lamps, a direct substitution is not possible because the T8 lamps are not compatible with the conventional T12 ballast. Therefore, to design a new ballast for the T8 lamps or to rewire the T12 ballast to accommodate T8 lamps would not be practical as any economic gain from the use of the T8 lamps would be offset by the higher cost of a new or rewired ballast device. Several problems occur when the smaller diameter T8 lamps are used with the standard T12 ballast. One problem is that the T8 lamps do not start reliably using the T12 ballast since the T12 ballast design was optimized for the easier to start T12 lamps. Another problem is that the operating characteristics of the T8 lamps are significantly different from the T12 lamps. If T8 lamps are connected to a T12 ballast and started by some external means, lamp voltage and current waveforms will be produced which are asymmetric and distorted, leading to considerable lamp flicker. The different operating characteristics also cause a larger RMS current to be drawn from the T12 ballast so that the lamp current exceeds the rated ballast load current by as much as 50 percent, which will lead to early ballast failure.

SUMMARY OF THE INVENTION

An object of the invention is to provide an inexpensive auxiliary network which permits a simple modification of a conventional two lamp rapid start ballast to provide reliable ignition and operation of two T8 lamps.

Another object of the invention is to provide an auxiliary series-parallel LC network that will operate as a shunt harmonic current source when connected to the ballast output to provide odd order higher harmonic currents to the lamps which promote proper reignition and stable lamp operation.

A further object of the invention is to provide an auxiliary network for connection in parallel with the T8 lamp or lamps which will provide reliable ignition and operation of the lamps from a standard rapid start T12 ballast.

The various objects and advantages of the invention are provided by an add-on ballast adaptor or auxiliary network which can be considered to be a shunt harmonic current source. This network comprises a basic series-parallel LC circuit that provides odd harmonic currents to the lamps (preferably seventh harmonic) so as to wave shape and correct the lamp current waveform. The auxiliary network produces the wave shaping of the current by adding the proper harmonics so that high current peaks are eliminated and flat areas can be added in order to produce a more symmetrical current waveform. At the same time, the auxiliary network reduces the RMS ballast current to a value within the ballast rating (e.g. 425 ma). The series-parallel LC network includes a first capacitor and a first inductor connected in series and a second capacitor and a second inductor connected in parallel circuit and with the parallel circuit connected in series circuit with the series connection of the first capacitor and the first inductor. This tuned LC network is connected in parallel with either one of the lamps, or in parallel across the series connection of the two lamps. The shunt harmonic current source is a tank circuit which can store and circulate harmonic currents, most of which flow in the lamps since the ballast is tuned to a much lower frequency, e.g. approximately 80 Hz to 90 Hz.

In the case where the auxiliary series-parallel LC network was connected in shunt with the series connection of two T8 lamps, it was found that reliable and consistent starting of the lamps could not be guaranteed for low values of the 60 Hz AC line voltage, e.g. at approximately 108 volts (RMS). In order to overcome this starting problem, a further embodiment of the invention provides a starting aid that comprises a resistor and a third capacitor (RC circuit) connected in a series circuit that is in turn connected in shunt with the series connection of the first capacitor and the first inductor. The first inductor may now include a tap point so that it is arranged as a split transformer. A SIDAC is coupled between the junction point of the resistor and the third capacitor and the tap point on the first inductor. The SIDAC will be triggered into conduction at the peaks of the voltage waveforms so that pulses are produced at the voltage peaks to promote lamp ignition. Once the lamps have ignited, the SIDAC will not trigger because the voltage across it will then be too low, i.e. below the trigger voltage threshold level of the SIDAC.

The novel ballast adaptor in accordance with the invention eliminates or reduces most of the asymmetry in the lamp current waveforms thereby eliminating the lamp flicker problem when T8 lamps are used with a ballast designed for T12 lamps. The shunt harmonic current source is compact in size and contains only a few passive and relatively inexpensive components so that there are no temperature or RF noise problems in the apparatus. The ballast adaptor makes it possible to substitute T8 lamps for T12 lamps in an existing luminaire containing a T12 ballast and without a costly and expensive retrofit operation. By reducing the high peak currents that would otherwise flow in each half cycle, the auxiliary circuit reduces the lamp current to a value within the rating of the T12 ballast. System efficacy was also improved for certain types of T8 lamps. The starting aid makes it possible to provide reliable lamp ignition with AC supply line voltages as low as 108 volts.

BRIEF DESCRIPTION OF THE DRAWING

Other advantages, features and objects of the invention will become apparent from the following detailed description of the invention taken in conjunction with the accompanying drawing in which.

DESCRIPTION OF THE PREFERRED EMBODIMENTS

Figure 1:
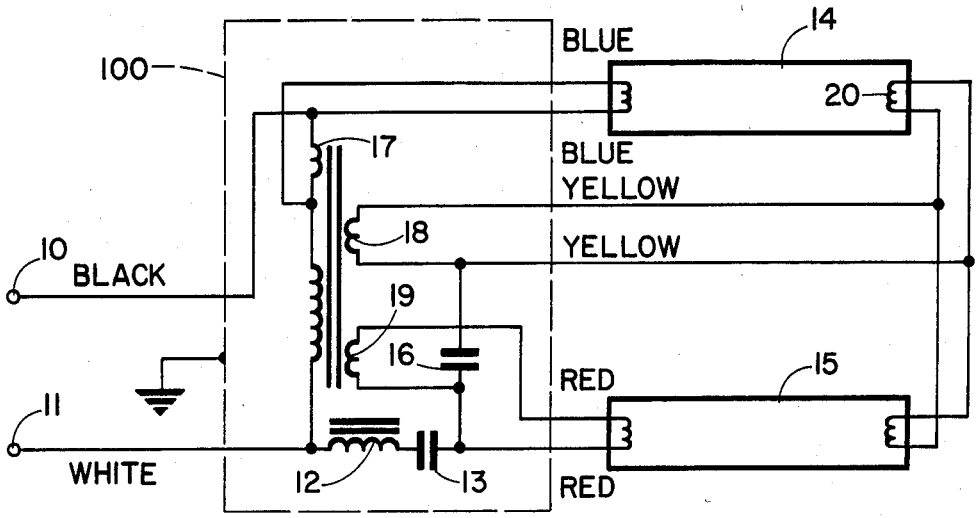
Fig. 1 Prior Art
FIG. 1 shows a standard T12 ballast for the ignition and operation of a pair of series connected T12 lamps.
Figure 2:
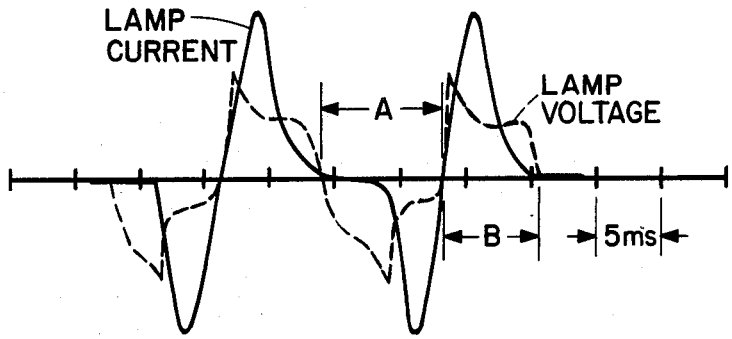
FIG. 2 shows T8 lamp current and voltage waveforms when operated directly from a two-lamp rapid start ballast designed for T12 lamps.

The problems involved in the use of T8 lamps with a ballast designed for T12 lamps can be better understood from the following brief description in connection with FIGS. 1 and 2 of the drawing. FIG. 1 shows a conventional ballast device 100 designed for use with T12 discharge lamps, for example, a G.E. Co. ballast designated type 7G1022W. A 120 V (RMS) 60 Hz AC supply voltage is applied to input terminals 10 and 11, generally designated as the black and white leads of the ballast device. This ballast functions as an autotransformer and includes an inductor 12 and a capacitor 13 connected in series with a load consisting of the series connection of two rapid start discharge lamps 14 and 15. A capacitor 16 assists in starting the lamps. Typically, inductor 12 has an inductance L of approximately 1 H., capacitor 13 has a capacitance C of approximately 4 $\mu$F, and capacitor 16 has a capacitance $C_s$ of approximately 0.05 $\mu$F.

The ballast device secondary winding, inductance and capacitance, together with the lamps, constitute a series resonant circuit with a resonant frequency of approximately 80 Hz. The ballast device 100 contains three isolated low voltage windings 17, 18 and 19 connected to heat the lamp filaments 20 etc. A typical operating voltage for an F40 T12 lamp is 105 V (RMS) with a normal operating current of 425 ma (RMS). Thus, the normal ballast output is 425 ma at 210 V.

FIG. 2 shows typical voltage and current waveforms for two T8 lamps operating from a standard, 40 W, two-lamp rapid start ballast designed for two T12 lamps, e.g. of the type shown in FIG. 1. Reignition occurs at the peak of the ballast output voltage, over 4 ms after the start of a half-cycle A. Time periods A and B are referred to as half-cycles even though the period A is slightly longer than the period B. The asymmetry in these time periods is believed to be related to the change in ballast/lamp resonant frequency which results from a change in the complex impedance of the lamps which occurs when the lamps reignite. Significant lamp current can not flow until after reignition. Thus, current flows only for 4 ms during the half-cycle A and is sharply peaked. The high electron density created in the lamps by this high peak current decays slowly enough so that the reignition voltage for the half-cycle B is greatly reduced, and lamp current begins to flow immediately, again reaching a high peak value.

Thus, current flows in two directions for a total of about 10 ms each cycle, and is off for about 6 ms. This asymmetric current wave form produces a visible low frequency flicker in the light output of the T8 lamps. The high peak currents in each half-cycle cause the RMS lamp current to exceed 600 ma, which is well above the rated ballast output current of 425 ma. The flicker problem and the high peak and RMS currents generated preclude the operation of T8 lamps as direct replacements for T12 lamps in standard, two-lamp rapid start ballast systems.

Figure 3:
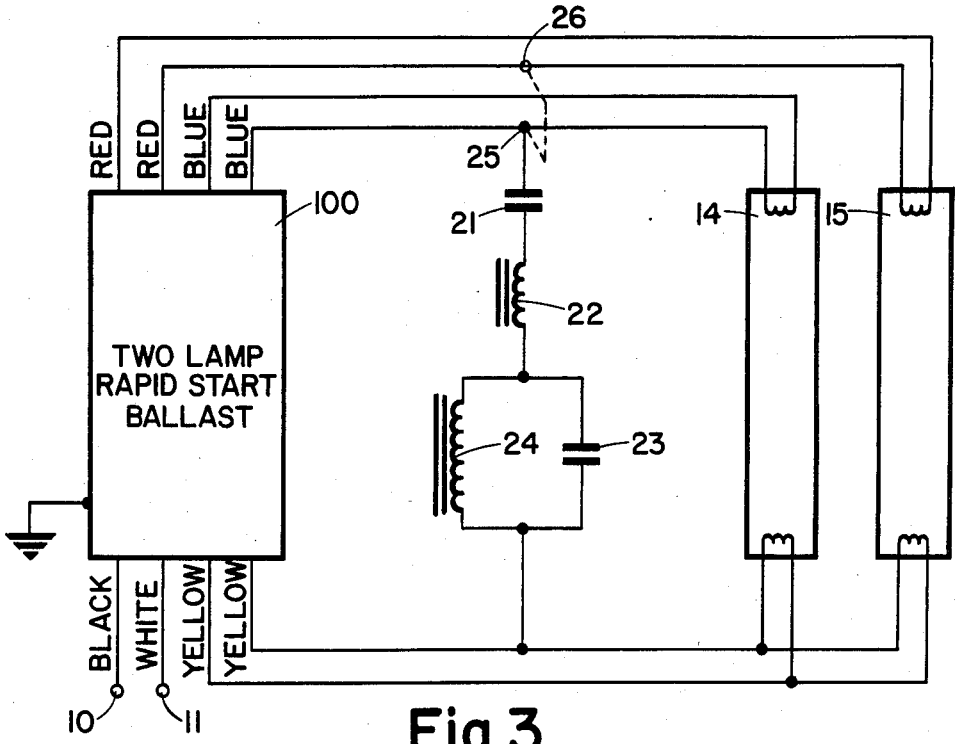
FIG. 3 shows a first embodiment of the invention for operation of a pair of series connected T8 lamps from a T12 rapid start ballast.

FIG. 3 shows a first preferred embodiment of the invention which makes it possible to connect a pair of T8 discharge lamps to a standard T12 ballast device 100 of the type shown in FIG. 1 so as to provide reliable operation of said lamps. In FIG. 3, the rapid start ballast device 100, designed for two T12 lamps, is shown in block schematic form for the sake of simplicity and clarity. It may consist of the G.E. ballast device mentioned above and will then have the internal circuitry and connections as shown in FIG. 1.

The series-parallel LC auxiliary network or shunt harmonic current source consists of a first capacitor 21 connected in series connection with a first inductor 22. A parallel circuit consisting of a second capacitor 23 and a second inductor 24 is connected in series circuit with the series connection of the capacitor 21 and inductor 22. The series-parallel LC circuit 21–24 is connected in parallel with the lamp 14, but it may alternatively be connected in parallel with the lamp 15 by removing the connection from capacitor 21 to point 25 and connecting it instead to point 26. The series tuned inductor and capacitor block the 60 Hz currents and the combination series and parallel tuned LC circuits store and circulate harmonic currents. The harmonic currents all flow predominantly in the lamps and satisfy the requirement of a T8 type of lamp for a greater amount of harmonic currents than the T12 ballast can supply by itself without distortion or exceeding its rated currents.

The series-parallel LC network is tuned so that the predominant current in the LC circuit occurs at an odd harmonic, preferably either the seventh or ninth harmonic, of the AC source voltage. The auxiliary LC network 21–24 provides seventh harmonic currents to the lamp to wave shape and correct the lamp's current waveform. Waveshaping the lamp current is accomplished by adding the proper harmonics so that the high current peaks can be eliminated to produce a more symmetrical current waveform. The LC network 21–24 also causes a reduction in the RMS ballast current to a level within the rating of a T12 ballast (approximately 425 ma). The ballast circuit of FIG. 3 eliminates most of the asymmetry in the lamp current waveform and thereby eliminates the lamp flicker problem. Typical component values for the auxiliary LC circuit are: $C_{21}=C_{23}=0.47$ $\mu$F, $L_{22}=23$ mH, and $L_{24}=49$ mH.

Figure 4:
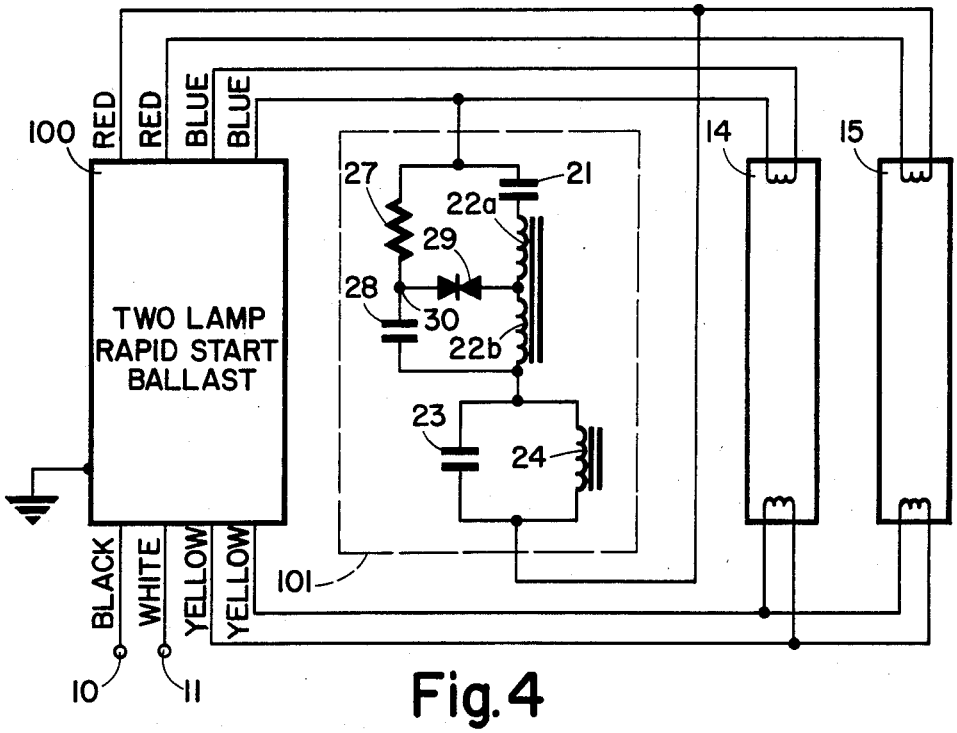
FIG. 4 shows a second embodiment of the invention which incorporates a starting aid to improve lamp ignition at low values of the AC supply voltage.

FIG. 4 illustrates a second improved embodiment of the invention in which the series-parallel resonant LC network is connected across the series combination of the lamps 14 and 15. The starting characteristic of the lamps at low values of the 60 Hz AC supply voltage, i.e. approximately 109 V, was not as good as it was for the circuit of FIG. 3 where the auxiliary LC network was connected across a single lamp. It was discovered that lamp starting could be improved by means of a high frequency voltage pulse starting aid circuit including a resistor 27 connected in series with a third capacitor 28. The series circuit of resistor 27 and capacitor 28 is connected in parallel with the capacitor 21 and the inductor 22 which is now in the form of two series-connected inductors 22*a* and 22*b*. A 120 V SIDAC 29 is connected between the junction point 30 and a tap point between split windings 22*a* and 22*b*. The entire series-parallel LC network with the starting aid can be accommodated within a compact ballast adaptor housing indicated schematically by the dashed line box 101. The two wires emerging from the housing 101 can be mounted on the tomb stone connections (not shown) at the end of the lamps. No cutting or rewiring is needed to connect the ballast adaptor to the lamps.

During the starting phase, capacitor 28 charges to 120 volts. The SIDAC 29 thus triggers at the peaks of the voltage wave-form and produces high voltage pulses through transformer action of the windings 22*a*, 22*b* at said peaks which promote starting of the lamps, especially when the AC line voltage is low. When the SIDAC is triggered it becomes a virtual short circuit discharging capacitor 28 across winding 22*b*. The windings 22*a* and 22*b* are connected in series aiding. By transformer action, the windings 22*a*, 22*b* develop a voltage pulse across the entire winding which is approximately 120 V times the turns ratio of inductors 22*a*, 22*b*. For example, for a turns ratio of 1:7.5, 120 $V \times (7.5/1) \approx 900$ V pulse. This pulse appears across the lamps and aids the lamp starting. The value of resistor 27 is chosen so that once the lamps have ignited, the SIDAC 29 will no longer be triggered into conduction because the voltage appearing across it will then be below its trigger threshold level. The shunt harmonic current source with the starting aid RC circuit of FIG. 4 will start and operate two T8 lamps from a standard rapid start ballast designed for two T12 lamps, and within the rated ballast current.

The series-parallel LC shunt harmonic circuits can be designed to fit into a relatively small adaptor unit that can be conveniently mounted on one end of a two-lamp luminaire intended for use with two T12 lamps. The luminaire can then accommodate two T8 lamps in place of the two T12 lamps, with the attendant advantages of the T8 lamps. The shunt harmonic circuits assure proper reignition and stable lamp operation by providing the harmonic currents required by the T8 lamps. These circuits can be connected in parallel with either one of the lamps or across the series combination of both lamps. The circuits produce flicker-free lamp operation while reducing the lamp current to a value within the current rating of the ballast device. Reliable starting of the lamps is provided, even for low values of the AC line voltage.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

We claim:

1. A ballast adaptor for connection to the terminals of a first type of discharge lamp so as to adapt said first type of discharge lamp for operation with a ballast device designed to operate with a second type of discharge lamp similar to the first type of lamp but having significantly different starting and operating characteristics, said adaptor comprising a series-parallel LC network adapted to produce an odd order harmonic current of an AC supply voltage, said series-parallel LC network including a series LC circuit connected to a parallel LC circuit.

2. A ballast system for operation of one or more discharge lamps of a first type comprising: a ballast device having a pair of input terminals for connection to a source of AC supply voltage and at least first and second output terminals for connection to one or more discharge lamps, said ballast device having been designed for use with one or more discharge lamps of a second type similar to the first type of lamp but having significantly different starting and operating characteristics, and a shunt harmonic current source network connected to said first and second output terminals of the ballast device so that the shunt harmonic current source network is in parallel with a discharge lamp when said lamp is connected to the ballast device output terminals, and wherein the shunt harmonic current source network comprises a series-parallel LC circuit including a first capacitor and a first inductor connected in series connection, a second capacitor and a second inductor connected in parallel circuit, and means connecting said parallel circuit in series circuit with the series connection of the first capacitor and the first inductor, the circuit elements of the shunt harmonic current source network being chosen so that at least one odd order higher harmonic current will be supplied by the shunt harmonic current source to said lamp in the operating condition of the lamp.

3. A ballast system as claimed in claim 2 wherein said first and second capacitors and said first and second inductors are chosen so that the series-parallel LC circuit is tuned to a seventh harmonic of the AC supply voltage at the input terminals of the ballast device.

4. A ballast system as claimed in claim 2 wherein said first inductor comprises first and second series connected coils with a tap point therebetween, said ballast system further comprising a resistor and a third capacitor connected in a series circuit that is connected in parallel with the series connection of the first capacitor and the first and second coils, and a voltage trigger element connected between a junction point between the resistor and the third capacitor and the tap point between the first and second coils.

5. A ballast system as claimed in claim 4 wherein the voltage trigger element comprises a SIDAC with a voltage trigger level of approximately 120 volts.

6. A ballast system as claimed in claim 4 wherein said first and second output terminals of the ballast device are adapted to be connected across first and second series-connected discharge lamps.

7. A ballast system as claimed in claim 4 wherein said first type of discharge lamp comprises a T8 lamp and the second type of discharge lamp comprises a T12 lamp.

8. A ballast system for operation of one or more discharge lamps of a first type comprising: a ballast device having a pair of input terminals for connection to a source of AC supply voltage and at least first and second output terminals for connection to one or more of said discharge lamps, said ballast device being designed for use with one or more discharge lamps of second type having a significantly different starting and operating characteristics from those of the first type of lamp, and a series-parallel LC network connectable to the first and second output terminals of the ballast device and including a series LC circuit connected to a parallel LC circuit, said series-parallel LC network being adapted to produce at said output terminals at least one odd order harmonic current when a lamp is connected to said output terminals.

9. A ballast adaptor for connection to the terminals of a first type of discharge lamp so as to adapt said first type of discharge lamp for operation with a ballast device designed to operate with a second type of discharge lamp similar to the first type of lamp but having significantly different starting and operating characteristics such that a direct substitution of the first type of lamp for the second type of lamp produces lamp flicker and unreliable starting characteristics in a system employing said ballast device, said adaptor comprising a series-parallel LC network adapted to produce higher order odd harmonic currents of the AC supply voltage, said series-parallel LC network including a first capacitor and a first inductor connected in series connection, a second capacitor and a second inductor connected in parallel circuit, and means connecting said parallel circuit in series circuit with the series connection of the first capacitor and the first inductor.

10. A ballast adaptor as claimed in claim 9 wherein said first type of discharge lamp comprises a T8 lamp and the second type of discharge lamp comprises a T12 lamp, and said first and second capacitors and said first and second inductors are chosen so that the series-parallel LC circuit is tuned to a seventh harmonic of the AC supply voltage.

11. A ballast adaptor as claimed in claim 9 wherein said first inductor comprises first and second series connected coils with a tap point therebetween, said adaptor further comprising a lamp starting aid including a resistor and a third capacitor connected in a series circuit that is connected in parallel with the series connection of the first capacitor and the first and second coils, and a voltage trigger element connected between a junction point between the resistor and the third capacitor and the tap point between the first and second coils.

12. A ballast adaptor as claimed in claim 11 wherein the voltage trigger element comprises a SIDAC with a voltage trigger level of approximately 120 volts and said elements of the ballast adaptor are packaged together in a compact housing unit adapted to be fastened to a luminaire for discharge lamps.

13. A ballast adaptor as claimed in claim 9 further comprising first and second terminals connected to end terminals of the series-parallel LC network and adapted for direct connection to first and second terminals, respectively, of said first type of discharge lamp.

14. A ballast adaptor as claimed in claim 9 intended for use with first and second series connected discharge lamps of said first type, said ballast adaptor further comprising first and second connection terminals for connecting the ballast adaptor across the series connection of the first and second series connected lamps.

15. A ballast system for operation of one or more discharge lamps of a first type comprising: a ballast device having a pair of input terminals for connection to a source of AC supply voltage and at least first and second output terminals for connection to one or more of said discharge lamps, said ballast device including transformer winding means connected to at least one of said output terminals and being designed for use with one or more discharge lamps of a second type having significantly different starting and operating characteristics than those of the first type of lamp, and a series-parallel resonant LC network connected to the first and second output terminals of the ballast device and adapted to produce at said output terminals at least one odd order harmonic current of the AC supply voltage frequency when an operating lamp is connected to said output terminals.

16. A ballast system as claimed in claim 15 wherein said resonant LC network includes inductance means and capacitance means that tune said network to a seventh harmonic of the AC supply voltage independently of said transformer winding means of the ballast device.

17. A ballast system as claimed in claim 15 wherein the AC supply voltage has a frequency of approximately 60 Hz and said ballast device further comprises inductance means and capacitance means coupled to the transformer winding means to form therewith a series resonant circuit with a resonant frequency of approximately 80 Hz.

18. A ballast adaptor as claimed in claim 9 for operation with a ballast device having transformer winding means, wherein said series-parallel LC network in resonantly tuned to an odd order harmonic of the AC supply voltage frequency independently of said transformer winding means of the ballast device.

19. A ballast adaptor for connection to the terminals of a first type of discharge lamp so as to adapt said first type of discharge lamp for operation with a ballast device designed to operate with a second type of discharge lamp having significantly different starting and operating characteristics than those of the first type of lamp, said adaptor comprising a series-parallel LC network resonantly tuned to an odd order harmonic of the AC supply voltage frequency independently of the ballast device so as to produce odd order harmonic currents of the AC supply voltage frequency, and means for connecting said LC network in parallel with at least one discharge lamp of the first type.

20. A ballast adaptor as claimed in claim 19 wherein the series-parallel LC network includes a capacitor serially conected with an inductance means, said adaptor further comprising a starting pulse generator comprising a series RC circuit coupled to said inductance means via a voltage trigger element having a threshold voltage determined by the operating voltage of the first type of discharge lamp.

* * * * *